US006519794B1

(12) United States Patent
Aarestad et al.

(10) Patent No.: US 6,519,794 B1
(45) Date of Patent: Feb. 18, 2003

(54) SIDE RAIL, SIDE RAIL KINEMATIC, AND LOCK LEVER AND LOCK PIN FOR SIDE RAIL

(75) Inventors: Jerome K. Aarestad, Escondido, CA (US); Randall J. Urness, Plover, WI (US); Dean R. Sommerfeld, Iola, WI (US); Todd C. Kramer, Plover, WI (US); Scott G. Williamson, Stevens Point, WI (US)

(73) Assignee: Sunrise Medical HHG Inc., Longmont, CO (US)

( * ) Notice: Subject to any disclaimer, the term of this patent is extended or adjusted under 35 U.S.C. 154(b) by 229 days.

(21) Appl. No.: 09/669,122

(22) Filed: Sep. 25, 2000

Related U.S. Application Data

(60) Provisional application No. 60/156,122, filed on Sep. 25, 1999.

(51) Int. Cl.[7] ..... A47C 21/08

(52) U.S. Cl. ..... 5/430; 5/428

(58) Field of Search ..... 5/430, 428, 425; 297/411.33

(56) References Cited

U.S. PATENT DOCUMENTS

| | | | | | |
|---|---|---|---|---|---|
| 3,585,659 | A | * | 6/1971 | Burst et al. | 5/430 |
| 3,971,083 | A | * | 7/1976 | Peterson | 5/430 |
| 4,217,670 | A | * | 8/1980 | Sciongay, Sr. et al. | 5/430 |
| 4,747,171 | A | * | 5/1988 | Einsele et al. | 5/430 |
| 4,993,089 | A | * | 2/1991 | Solomon et al. | 5/430 |

* cited by examiner

*Primary Examiner*—Alexander Grosz
(74) *Attorney, Agent, or Firm*—MacMillan, Sobanski & Todd, LLC

(57) ABSTRACT

A side rail comprises a main body and a pair of lever arms. A first lever arm has an upper end movably supported relative to the main body by an upper pivot pin and a lower end movably attached to the bed by a lower pivot pin. A second lever arm has an upper end movably supported relative to the main body by an upper pivot pin and a lower end movably attached to the bed by a lower pivot pin. The pivot pins are arranged so that the pivot pins do not come into linear alignment with one another during movement of the lever arms.

19 Claims, 14 Drawing Sheets

SIDE RAIL, SIDE RAIL KINEMATIC, AND LOCK LEVER AND LOCK PIN FOR SIDE RAIL

CROSS-REFERENCE TO RELATED APPLICATIONS

This application claims the benefit of U.S. Provisional Patent Application No. 60/156,122, filed on Sep. 25, 1999.

BACKGROUND OF THE INVENTION

This invention relates in general beds and more particularly to a side rail for beds, especially beds and articulated beds of the type that are used in healthcare or home care environments. Most particularly, the invention relates to movable side rails and kinematic motion and locks for movable side rails.

Movable side rails for beds are well known. Conventional side rails are generally supported relative to a bed frame by movable arms. The arms are arranged parallel relative to one another and include opposing ends. One end of each arm is pivotally attached to the bed frame at a fixed pivot point. The other ends of the arms are pivotally attached to opposite ends of the side rail at orbital pivot points. The side rail, bed frame, and arms cooperate to form a parallelogram. As the side rail encounters movement, the arms pivot on the fixed pivot points. The orbital pivot points orbit about the fixed pivot points. When the fixed and orbital pivot points come into linear alignment, the arms tend to bind because of manufacturing tolerances.

What is needed is a side rail that moves without binding or a kinematic motion for a side rail that reduces the risk that the side rail will bind when moved.

SUMMARY OF THE INVENTION

The present invention is directed towards a side rail for a convalescent bed that is structured to move without binding. The side rail comprises a main body and a pair of lever arms. A first lever arm has an upper end movably supported relative to the main body by an upper pivot pin and a lower end movably attached to the bed by a lower pivot pin. A second lever arm has an upper end movably supported relative to the main body by an upper pivot pin and a lower end movably attached to the bed by a lower pivot pin. The pivot pins are arranged so that the pivot pins do not come into linear alignment with one another during movement of the lever arms.

Various objects and advantages of this invention will become apparent to those skilled in the art from the following detailed description of the preferred embodiment, when read in light of the accompanying drawings.

DESCRIPTION

Figure 1:
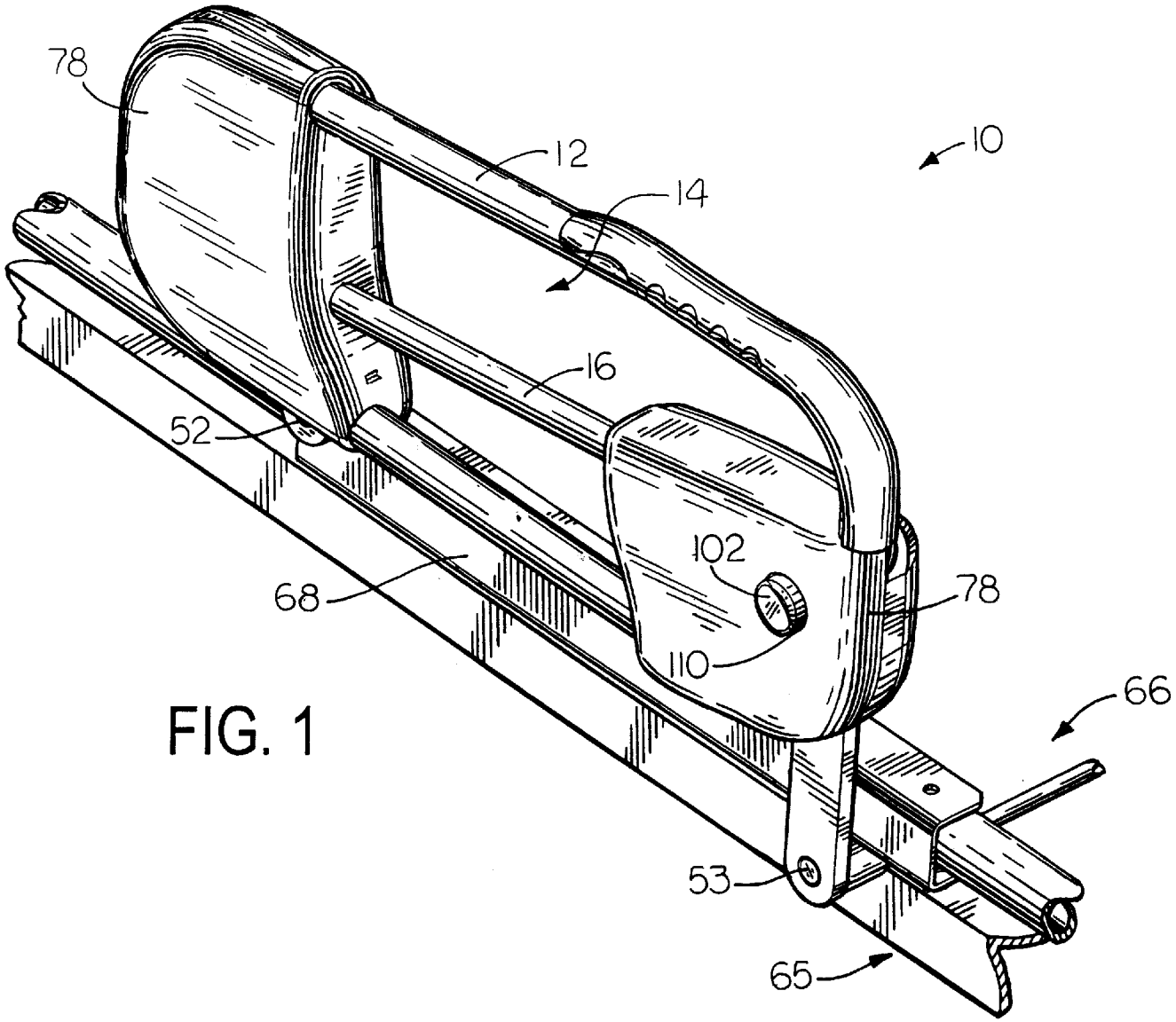
FIG. 1 is an outer front perspective view of a side rail attached to a sleep surface section via a bracket mounting plate wherein the side rail is in a raised position.
Figure 2:
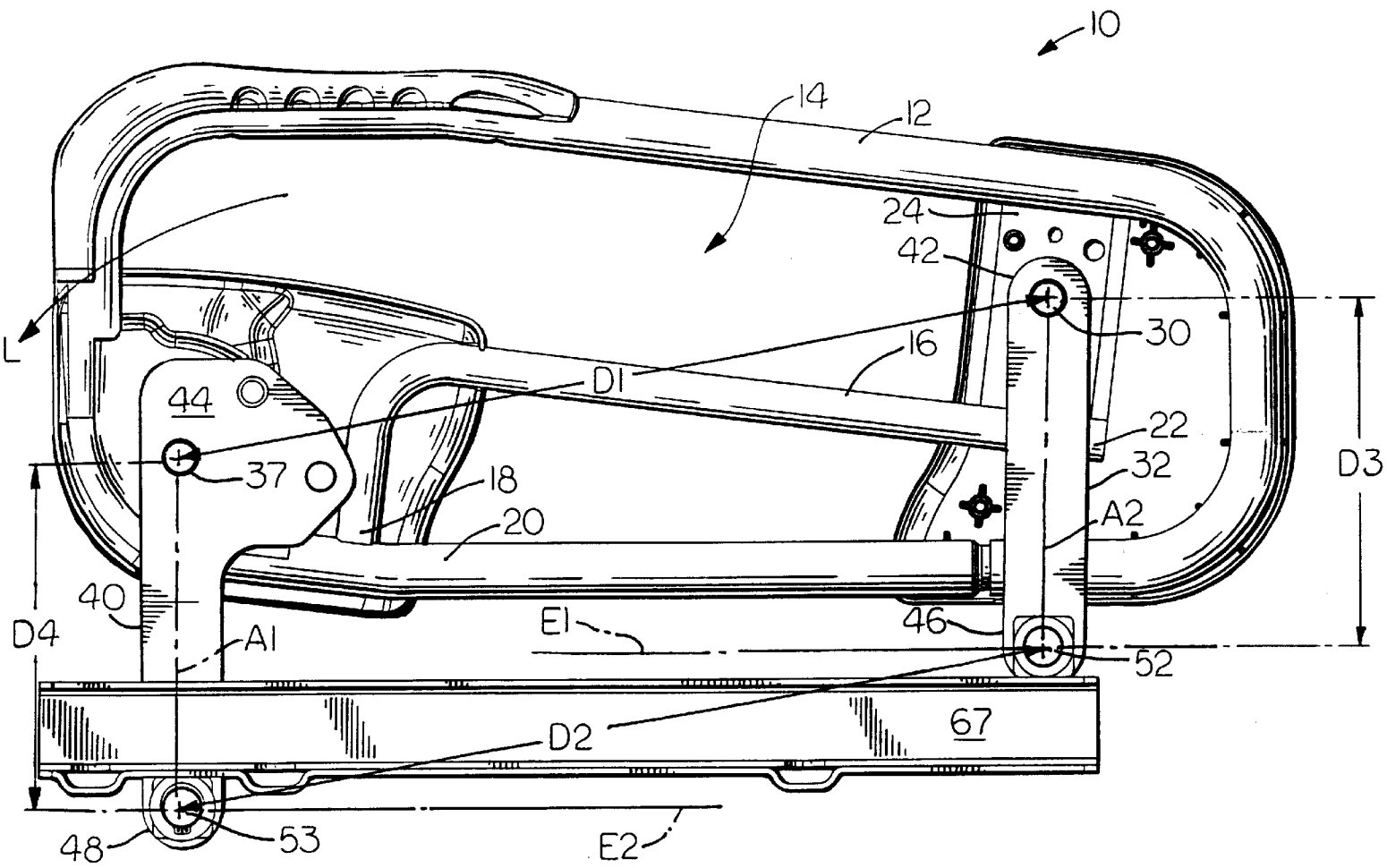
FIG. 2 is an inner side elevational view of the side rail shown in FIG. 1 with the inner housing removed from the front and rear ends of the side rail.

Referring now to the drawings, there is illustrated in FIGS. 1 and 2, a side rail 10 for use with a convalescent bed (not shown). The side rail 10 is displaceable between a lowered position to a raised position. When the side rail 10 is in a lowered position, an occupant (also not shown) of the bed may ingress and egress from the bed with greater ease. An attendant may also gain access to a bed occupant to service the occupant when the side rail 10 is in a lowered position. In a raised position, the side rail 10 provides a barrier to reduce the risk of a bed occupant falling off the sleep surface of the bed.

The side rail 10 includes a main body which is preferably constructed of tubular material shaped in the form of a hoop 12. A tubular hoop 12 is preferred because tubular material is substantially easy to bend or shape. Moreover, a tubular hoop 12 provides a strong structure that is highly resistant to the effects of torsional forces. In addition, a tubular hoop 12 provides a smooth surface for ease in handling. An ideal smooth surface would be absent any sharp surfaces to reduce the risk that a bed occupant would encounter injury from contact with the side rail 10.

The tubular hoop 12 defines an opening 14. The opening 14 should not be so large that a bed occupant is permitted to pass his or her head through the opening 14. This may be hazardous to the bed occupant because the occupant may by chance pass his or her head through the opening 14 and not be permitted to remove his or her head from the opening 14.

If the opening 14 is undesirably large, the opening 14 may be broken up by a member such as the L-shaped member 16 shown in FIG. 2. A first or lower end 18 of the L-shaped member 16 may be fastened to a lower portion 20 of the tubular hoop 12. A second or upper end 22 of the L-shaped member 16 may be disposed within the opening 14.

Figure 3:
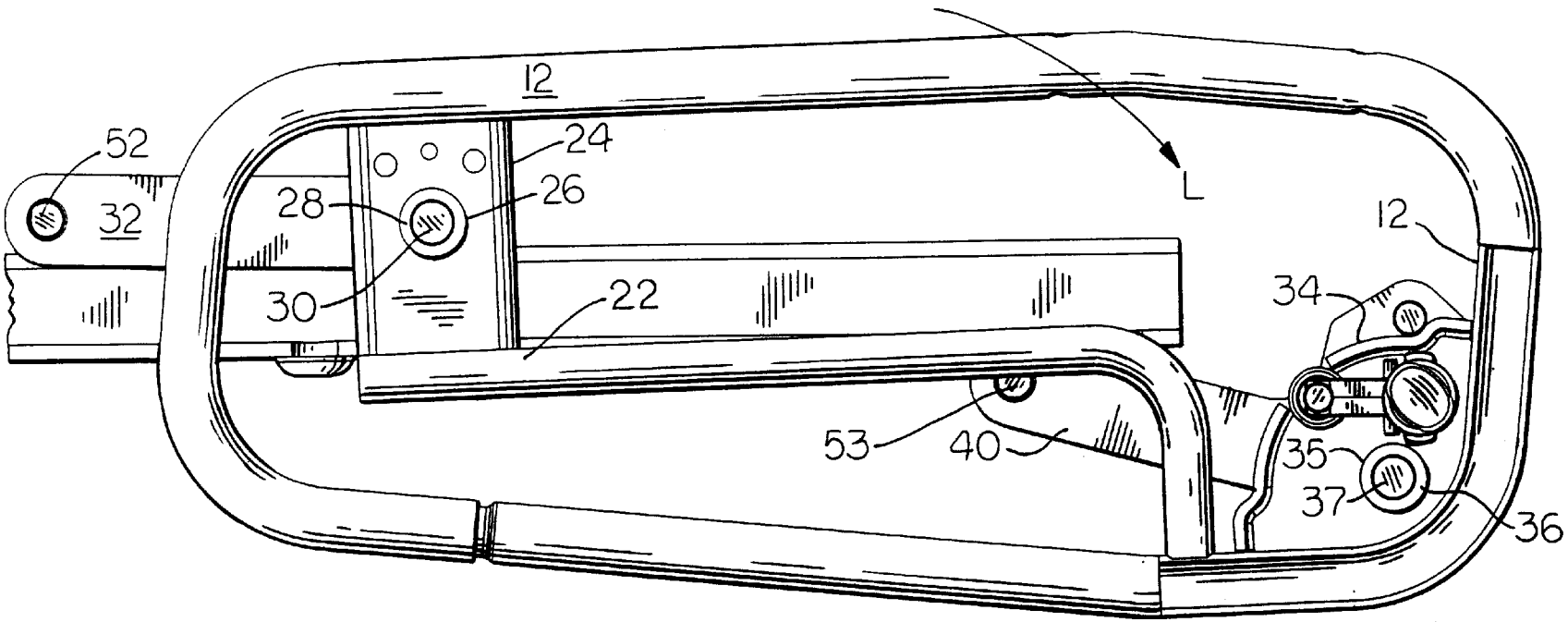
FIG. 3 is an outer side elevational view of the side rail shown in FIG. 1 in a partially lowered position with the housing completely removed from the front and rear ends of the side rail.

A first or upper bracket 24 may be connected between the upper end 22 of the L-shaped member 16 and an upper portion of the tubular hoop 12. As illustrated in FIG. 3, the upper bracket 24 holds the upper end 22 of the L-shaped member 16 in a fixed position relative to the tubular hoop 12. The upper bracket 24 is provided with an aperture 26. The aperture 26 is adapted to receive a bushing 28. The bushing 28 is provided for receiving a first upper pivot pin 30. The first-upper pivot pin 30 movably supports a first or follower lever arm 32 relative to the upper bracket 24. The purpose of the follower lever arm 32 will become more apparent in the description that follows.

An opposite end of the tubular hoop 12 is provided with a second or lower bracket 34. This bracket 34 is provided with an aperture 35 adapted to receive a bushing 36. The bushing 36 is provided for receiving a second upper pivot pin 37 for movably supporting a second or driver lever arm 40 relative to the lower bracket 34 in a spaced apart relation to the follower lever arm 32. The purpose of the driver lever arm 40 is similar to that of the follower lever arm 32, as will become more apparent in the description that follows.

It should be understood that the tubular hoop 12 may be formed in a myriad of ways and that the L-shaped member 16 and the brackets 24, 34 may be attached accordingly in any suitable manner. For example, the tubular hoop 12 may be constructed of a single loop, as shown in the drawings. Alternatively, the hoop 12 may be constructed of opposing U-shaped members (not shown). The legs of one of the U-shaped members may include a reduced diameter portion adapted to be inserted in the legs of the other U-shaped member to engage the opposing U-shaped members. Once the legs of the opposing U-shaped members are engaged, the legs may be fixed together in any suitable manner. It is most preferable that the engaged legs be fixed together permanently, such as by welding, fusing, or adhering the engaged legs together. The L-shaped member 16 and the brackets 24, 34 may likewise be attached to each other and to the tubular hoop 12 accordingly by welding, fusing, or adhering the L-shaped member 16 and the brackets 24, 34 to each other and to the tubular hoop 12.

As stated above, lever arms 32, 40 are movably attachable to the brackets 24, 34. The lever arms 32, 40 support the tubular hoop 12 so that the tubular hoop 12 may be displaced. One of the lever arms may control the displacement of the tubular hoop 12 and thus be referred to as a driver lever arm 40. The other lever arm is displaceable in response to movement of the driver lever arm 40 and thus may be referred to as a follower lever arm 32.

Figure 4:
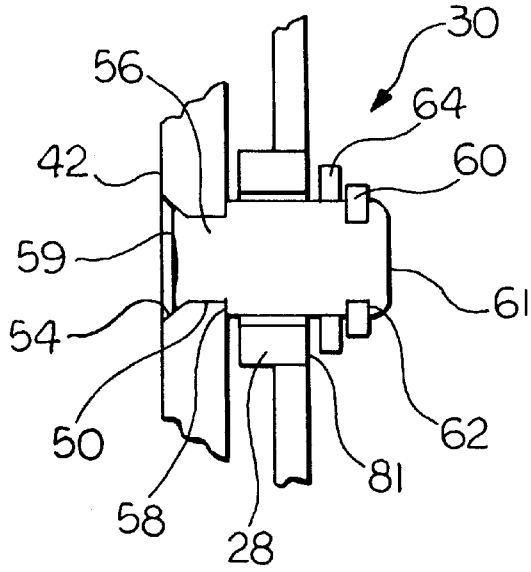
FIG. 4 is an enlarged diagrammatic representation shown cross section of a manner in which an upper pivot pin may be attached to a lever arm.

As illustrated in FIG. 2, each lever arm 32, 40 includes an upper end 42, 44 and a lower end 46, 48. The upper and lower ends 42, 44, 46, 48 of the lever arms 32, 40 may each include an aperture for receiving a pivot pin 30, 37, 52, 53. An example of the upper end 42 of a lever arm 32 is shown in FIG. 4. The other ends 44, 46, 48 may be fashioned in the same manner. The end 42 shown includes a substantially cylindrical aperture 50 having a chamfered inner surface 54. The pivot pin 30 may be provided with a reduced diameter portion 56 that terminates at a shoulder 58. It is preferable that the reduced diameter portion 56 be machined within a close tolerance of the substantially cylindrical aperture 50 so that an interference fit is provided between the substantially cylindrical aperture 50 and the reduced diameter portion 56. The reduced diameter portion 56 may be pressed into the substantially cylindrical aperture 50 until the shoulder 58 engages the outer surface of the end 42 of the lever arm 32. After the pivot pin 30 is pressed into the aperture 50, the inner end 59 of the pivot pin 30 may be staked or distorted against the chamfered inner surface 54 of the substantially cylindrical aperture 50 to reduce the risk of the pivot pin 30 working free from the lever arm 32.

The pivot pins 30, 37 at the upper ends 42, 44 of the lever arms 32, 40 may be inserted into and through the bushings 28, 36 supported by the apertures 26, 35 in the upper and lower brackets 24, 34. Once inserted through the bushings 28, 36, the pivot pins 30, 37 may be fastened in place. FIG. 4 shows one manner in which the first upper pivot pin 30 may be fastened. The second upper pivot pin 37 may be fashioned in a similar manner. A retaining clip 60, such as an E-ring, may be fastened to the outer end 61 of the pivot pin 30 to prevent the pivot pin 30 from working free from the bushing 28. The outer end 61 of the pivot pin 30 may be provided with an annular groove 62 for receiving the retainer clip 60. It may be desirable to provide a thrust washer 64 between the outer end 81 of the bushings 28, 36 and the retaining clip 60 to limit lateral or axial displacement of the pivot pin 30 relative to the bushing 28.

The pivot pins 52, 53 at the lower ends 46, 48 of the lever arms 32, 40 are movably attachable to the bed (not shown). As shown in FIG. 1, the pivot pins 52, 53 may be attached to the sleep surface 66 of the bed or the main frame 65 of the bed adjacent to the sleep surface 66. For articulated beds, the pivot pins 52 are preferably attached to the sleep surface 66 to permit the side rails 10 to be displaced with the sleep surface 66. The pivot pins 52, 53 may be attached to the sleep surface 66 in any suitable manner. One manner in which the lower pivot pins 52, 53 may be fastened is as follows. The lower pivot pins 52, 53 may be attached through the use of a mounting bracket, such as the bracket mounting plate 68 shown. The lower pivot pins 52, 53 may be attached to opposing end portions of the bracket mounting plate 68. The bracket mounting plate 68, in turn, may be attached to the sleep surface 66.

Figure 5:
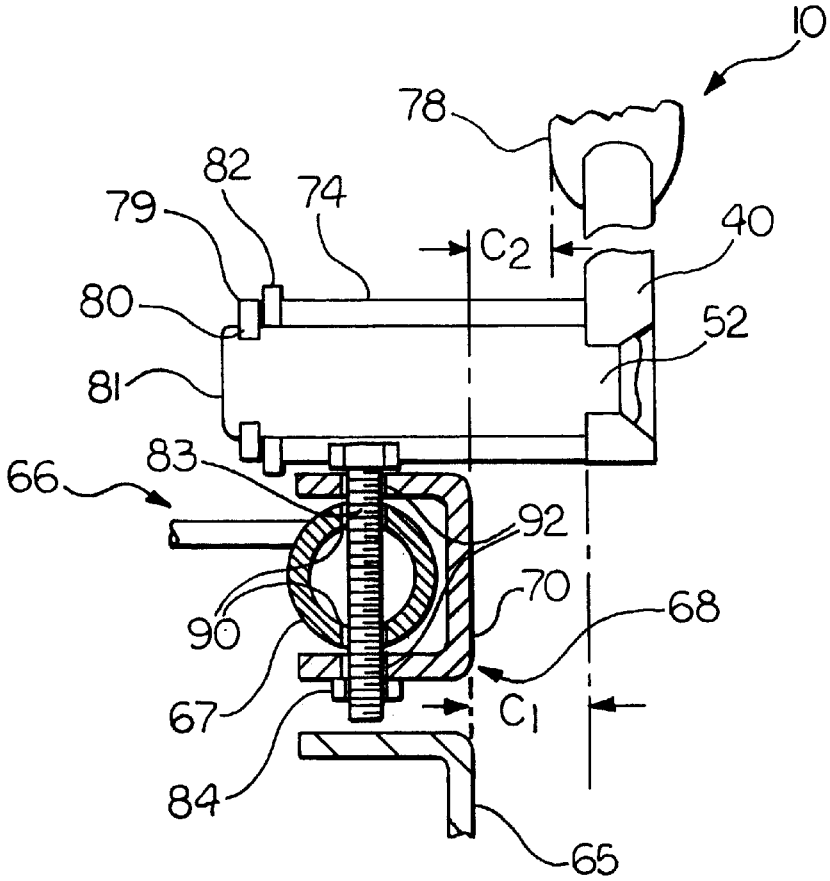
FIG. 5 is an enlarged diagrammatic representation shown cross section of a manner in which a lower pivot pin may be attached to a sleep surface section.

The lower pivot pins 52, 53 may be attached to the bracket mounting plate 68 in any suitable manner. FIG. 5 shows one manner in which the first lower pivot pin 52 may be attached. The second lower pivot pin 53 may be attached in a similar manner. An end portion 70 of the bracket mounting plate 68 may be provided with a lower bushing 74 for receiving the first lower pivot pin 52. It is preferable that the lower bushing 74 cantilever or extend laterally outward from the end portion 70 of the bracket mounting plate 68 to provide clearance C1 between the lever arm 40 and the main frame 65 or the sleep surface 66 for movement of the lever arm 40. In the event that the side rail 10 is contained within a housing, such as the housing 78 shown, to provide protection to a bed occupant from movement of the lever arm 40, a lower bushing 74 may provide suitable clearance C2 between the housing 78 and the main frame 65 or sleep surface 66.

The first lower pivot pin 52 may be inserted into and through the lower bushing 74. An annular groove 80 is provided in an outer end 81 of the first lower pivot pin 52 for receiving a retaining clip 79 for securing the first lower pivot pin 52 in place relative to the lower bushing 74. A thrust washer 82 may be provided between the lower bushing 74 and the retaining clip 79 to limit lateral or axial displacement of the pivot pin 52 relative to the lower bushing 74.

The bracket mounting plate 68 may be in the form of a longitudinal C-shaped channel adapted to receive a section of the sleep surface 66. The bracket mounting plate 68 may be attached to the sleep surface 66 in any suitable manner. For example, the bracket mounting plate 68 may be attached with releasable fasteners, such as the threaded fastener 83 shown. An example of a sleep surface section 67 is shown in cross-section in FIG. 5. The sleep surface section 67 is constructed from tubular material having longitudinally spaced holes 90 passing vertically through the sleep surface section 67. The bracket mounting plate 68 likewise has longitudinally spaced holes 92 passing vertically through the bracket mounting plate 68. The holes 92 in the bracket mounting plate 68 are adapted to be positioned to align axially with the holes 90 in the sleep surface section 67. A threaded fastener 83 may be inserted into and through each of the aligned holes 90, 92. The fastener 83 may be threadably engageable with a nut 84 to secure the bracket mounting plate 68 to the sleep surface section 67. It should be understood that the foregoing manner of attachment is provided for illustrative purposes and that other manners of attachment may be suitable.

As clearly shown in FIG. 2, the lower pivot pins 52, 53 shown are attached to the sleep surface section 67 at different elevations E1, E2 relative to one another and relative to the sleep surface section 67 to maintain a desired orientation of the hoop 12 at raised and lowered positions. It should be noted that other elevations may be suitable of carrying out the invention.

In addition, the pivotal movement of the lever arms 32, 40 is slightly out of phase relative to one another. In other words, the driver lever arm 40 slightly leads the follower lever arm 32 as the side rail 10 is moved in a first direction, such as downward in a direction of the arrow L. Conversely, the driver lever arm 40 slightly trails the follower lever arm 32 as the side rail 10 is moved in a second direction, such as upward in a direction opposite of the arrow L. This leading-trailing relationship eliminates the risk of the four pivot pins 30, 37, 52, 53 coming into linear alignment with one another at any time during the movement of the lever arms 32, 40.

An example of a manner in which the foregoing leading-trailing relationship may be achieved is as follows. The upper and lower pivot pins 37, 53 of the driver lever arm 40 may be aligned along a first axis A1 that is substantially vertical or substantially perpendicular relative to the bracket mounting plate 68, as shown in FIG. 2. The upper and lower pivot pins 30, 52 of the follower lever arm 32 may be aligned along a second axis A2. The distance D1 between the upper pivot pins 30, 37 is preferably slightly greater than the distance D2 between the lower pivot pins 52, 53. As a result, the follower lever arm 32 is at a slight angle relative to the driver lever arm 40. The upper ends 42, 44 of the lever arms 32, 40 diverge slightly from one another. For example, the distances D3, D4 between the upper and lower pivot points 42, 44, 52, 53 of the lever arms 32, 40 may each be about 6.5 inches. It is preferable that these distances D3, D4 be substantially the same. Accordingly, the distance D1 between the upper pivot pins 52 of the lever arms 32, 40 may be about 16.625 inches and the distance D2 between the lower pivot pins 52 may be about 16.5 inches. These distances D1, D2 are with respect to the lever arms 32, 40 being in a raised position. It should be noted that the distance D1 between the upper pivot pins 52 is about 0.125 inch greater than the distance D2 between the lower pivot pins 52. This provides a suitable divergent relationship between the movement of the two lever arms 32, 40. The amount of divergence may depend upon the physical characteristics of the side rail 10, the lever arms 32, 40, and the bracket mounting plate 68, as well as the physical characteristics of the bed.

Figure 6:
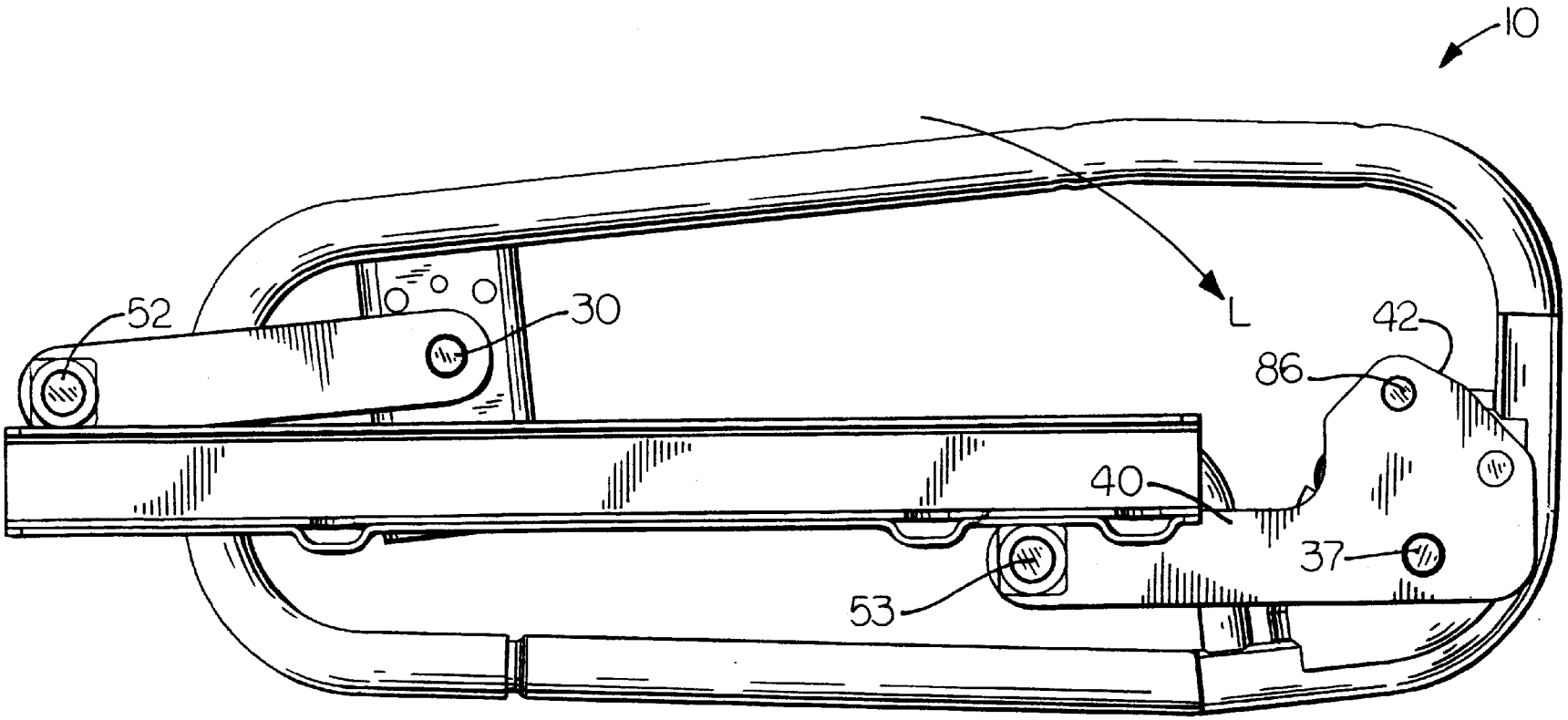
FIG. 6 is an inner side elevational view of the side rail shown in FIG. 3 in a lowered position.

The operation of the side rail bed 10 is best understood with reference to the diagrammatic representation in FIGS. 2, 3, and 6. As set forth above, the side rail 10 is pivotally displaceable between a raised position, shown in FIG. 2, and a lowered position, shown in FIG. 6. From the raised position, the side rail 10 may be lowered by moving the side rail 10 downward along an arcuate path in the direction of arrow L. The side rail 10 may be moved upward in a direction opposite of arrow L to a raised position. Throughout the movement of the side rail 10, the four pivot pins 30, 37, 52, 53 are prevented from coming into linear alignment with one another due to the leading-trailing relationship in the movement of the lever arms 32, 40. This eliminates the risk of the lever arms 32, 40 binding.

Figure 7:
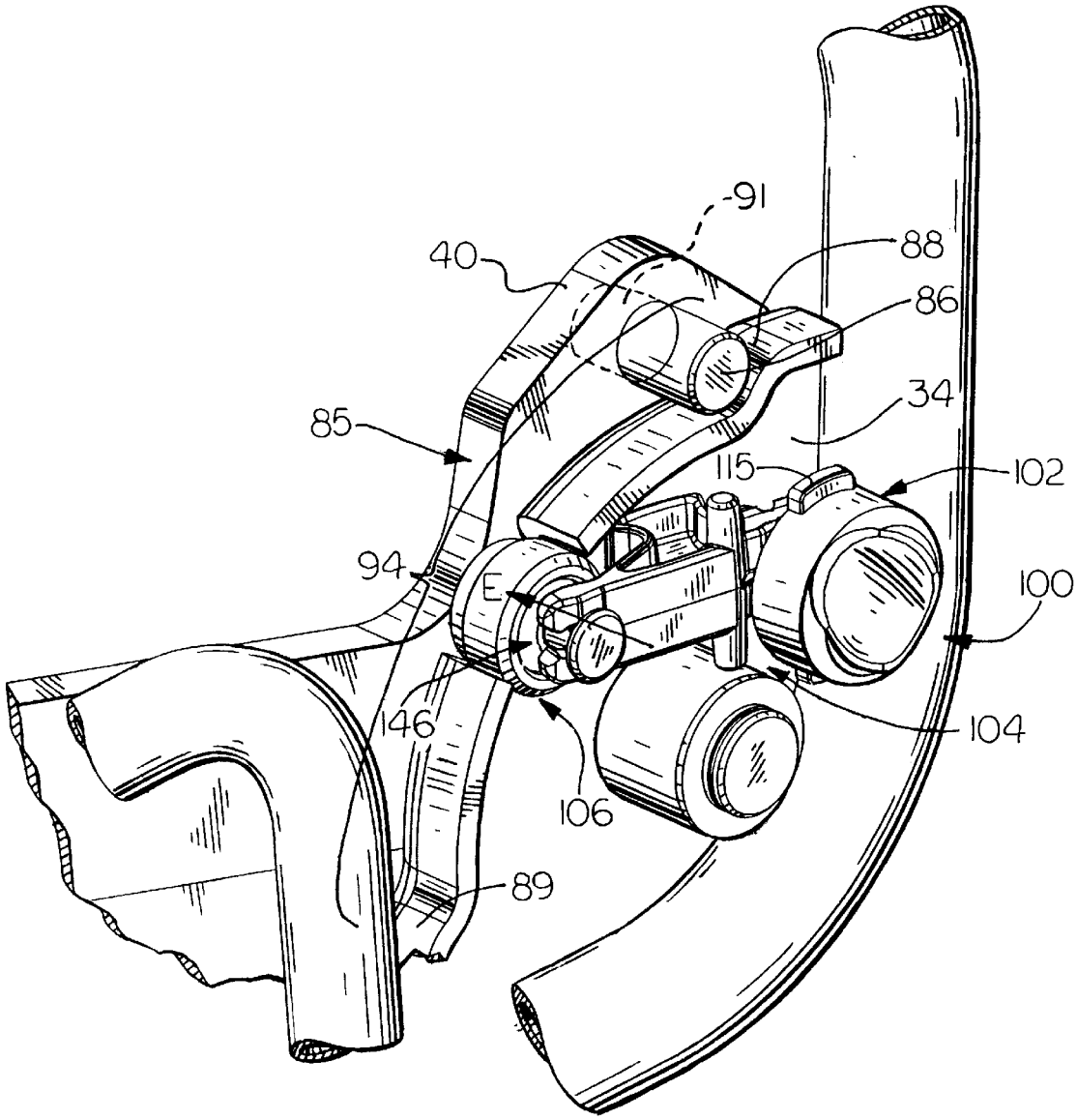
FIG. 7 is an enlarged perspective view of a stop pin engaging an upper abutment surface and a lock in an unlocked position.
Figure 8:
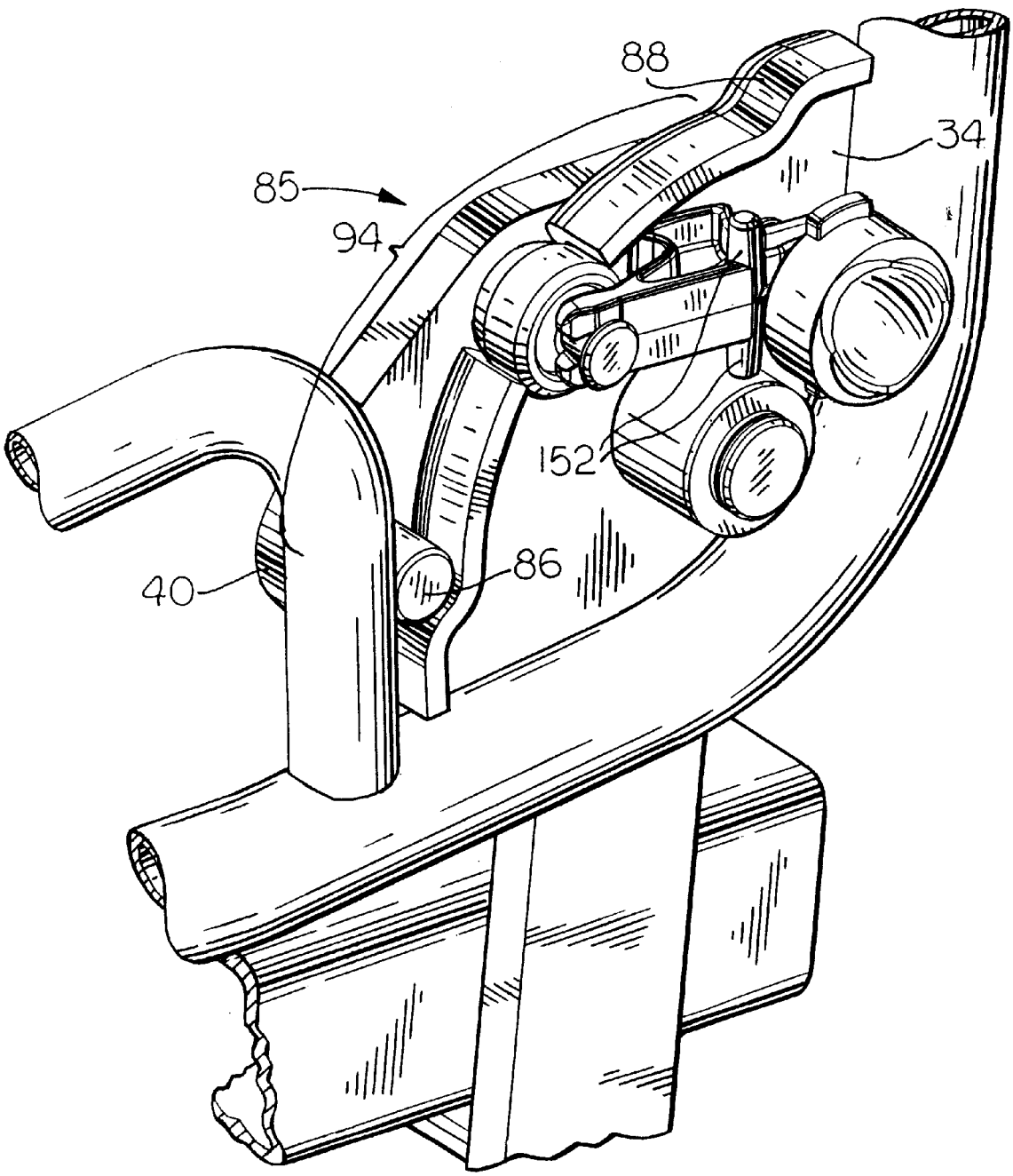
FIG. 8 is an enlarged perspective view of a stop pin engaging a lower abutment surface and a lock in a locked position.

To limit the movement of the lever arms 32, 40, a stop device 85 may be employed. An example of a stop device is shown in FIGS. 7 and 8. This stop device includes a stop pin 86 supported by the driver lever arm 40. The stop pin 86 may be pressed in a stop pin aperture 91 provided in the driver lever arm 40. The lower bracket 34 may be provided with upper and lower abutment surfaces 88, 89. An arcuate path 94 may be formed between the upper and lower abutment surfaces 88, 89. The arcuate path 94 may be in the form of a relief in the front perimeter of the lower bracket 34. The stop pin 86 may travel along the arcuate path 94 guided by a rib or lip that extends between the upper and lower abutment surfaces 88, 89. The stop pin 86 may travel along an arcuate path 94 as the driver lever arm 40 is raised and lowered. The driver lever arm 40 reaches the lowered position when the stop pin 86 abuts the upper abutment surface 88 (shown in FIG. 7) and reaches the raised position when the stop pin 86 abuts the lower abutment surface 89 (FIG. 8).

As is shown in FIG. 6, the stop pin 86 is supported by an irregularly shaped portion formed by the upper end 42 of the driver lever arm 40. The irregularly shaped portion does not exceed or extend beyond the housing 78 to reduce the risk of injuring a bed occupant by movement of the driver lever arm 40. Although the stop pin 86 extends into the arcuate path 94, the remainder of the upper end 42 of the drive lever arm 32 remains substantially within the perimeter of the lower bracket 34.

Figure 9:
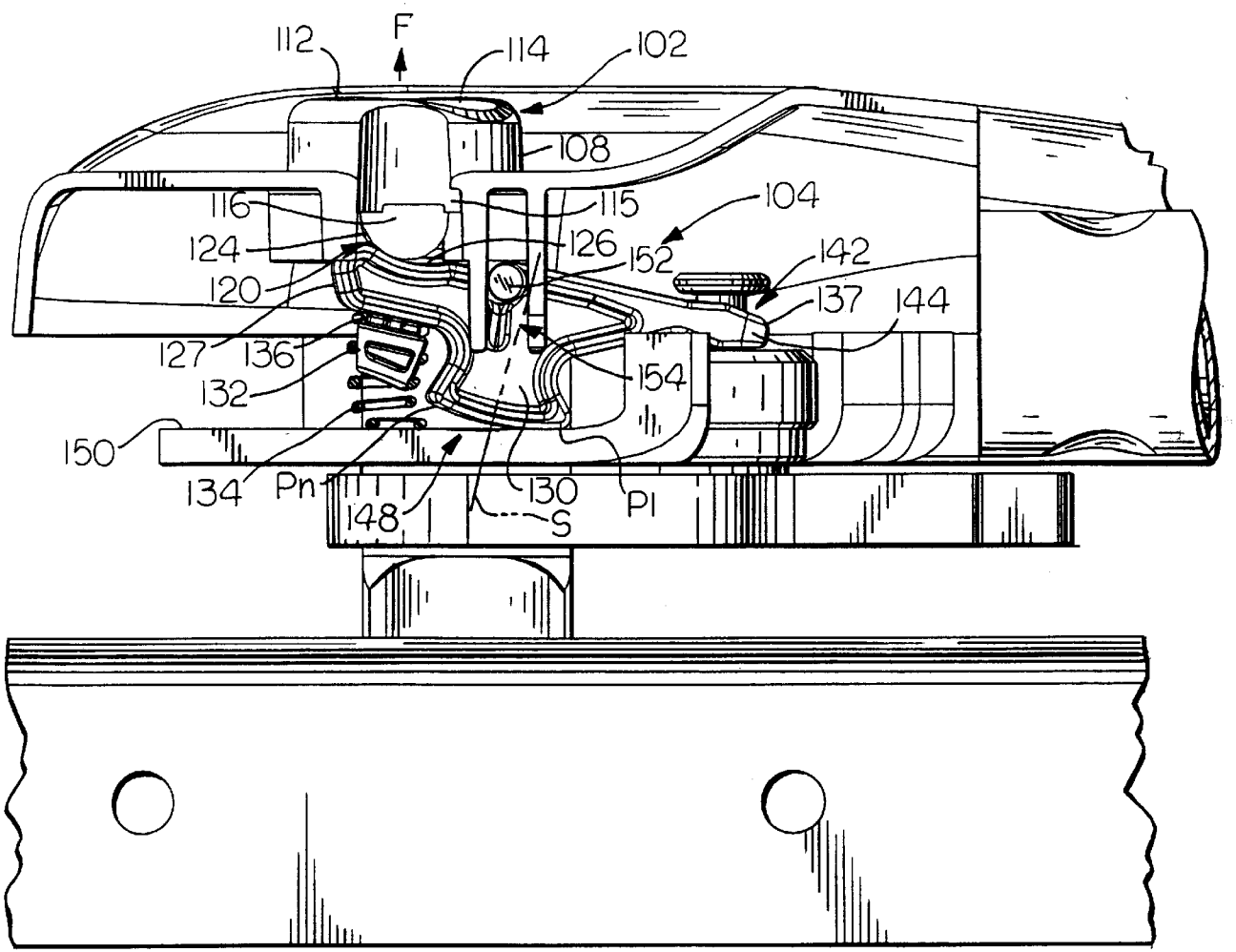
FIG. 9 is a top plan view of the lock shown in FIG. 7.

A lock 100 may be provided for locking the side rail 10 in a raised or lowered position. An example of a lock 100 for locking the side rail 10 in a raised position is shown in FIGS. 7 and 9. The lock 100 includes a button 102 that is engageable with a lever 104. The lever 104, in turn, is engageable with a lock pin 106. The lock pin 106 is normally biased inward in the direction of arrow E (FIG. 7). Upon pressing the button 102, the lock pin 106 may be displaced in a direction opposite of arrow E. The lock 100 may be supported in the housing 78. A more detailed description of the lock 100 is as follows, beginning with a description of the button 102.

Figure 10:
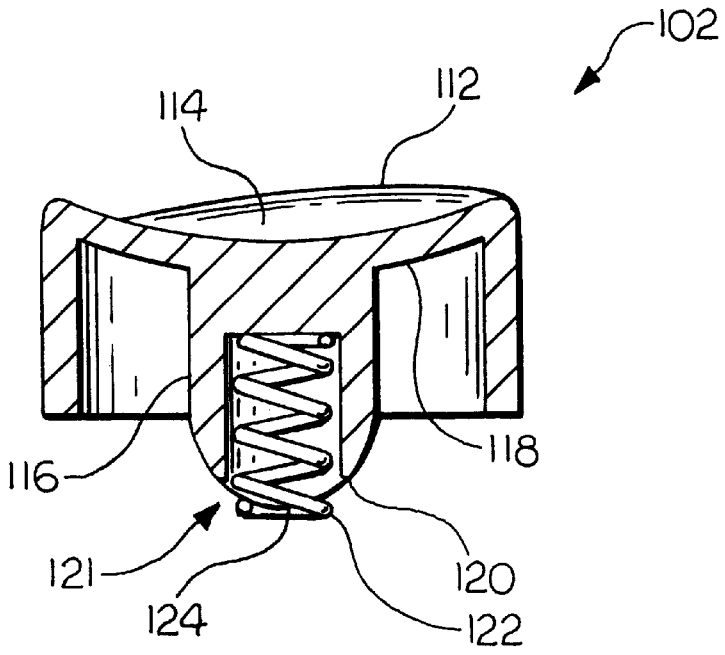
FIG. 10 is a sectional view of a button of the lock shown in FIGS. 7 through 9.

As shown in FIGS. 9 and 10, the button 102 may include a first or outer portion 108. Although the outer portion 108 may be substantially any suitable shape, a cylindrically shaped outer portion is preferred. The outer portion 108 is displaceable within a hole 110 (shown in FIG. 1) in the housing 78. The hole 110 is shaped and dimensioned to complement the shape of the outer portion 108. It is most preferable that the outer portion 108 protrude at least slightly from the hole 110 so as to be easily identified by the tactile senses. An outer end 112 of the outer portion 108 further may include a thumb detent 114 to provide an ergonomic fit for the operator's thumb (not shown) upon pressing the button 102. It is preferred that the thumb detent 114 have a diagonal orientation, as shown in the drawings, to enhance the comfort of the button 102 to the operator. To maintain the orientation of the thumb detent 114, the button 102 may be provided with anti-rotation ears or tabs 115 (also shown in FIG. 7) that extend radially from an inner end of the outer portion 108. As shown in FIG. 9, the anti-rotational tabs 115 cooperate with the housing 78 to maintain the orientation of the button 102 relative to the housing 78.

As shown in FIG. 10, a tube 116 originates from an inner surface 118 of the outer portion 108. An inner end 120 of the tube 116 has an opening 121 for receiving a first biasing element, such as a helical spring 122. The button spring 122 is under compression so as to urge the button 102 outward in the direction of arrow F shown in FIG. 16. The button spring 122 also urges the lever 104 inward in a direction opposite to the direction of arrow F. In this way, the button 102 is returned to a non-depressed position when the button 102 is released by an operator.

As shown in the drawings, the inner end 118 of the tube 116 also includes a curved surface 124 that is adapted to ride on a portion of the lever 104. The portion of the lever 104 that the curved surface 124 engages may be referred to as the button receiver 126 (shown in FIG. 9). As shown in FIG. 9, the button receiver 126 is defined by an outer surface of a first or front cantilevered leg 127 which extends forward from of a main body portion 130 of the lever 104. A support element 132 protrudes inwardly from the bottom of the front cantilevered leg 127. The support element 132 is adapted to support a second biasing element, such as the lever spring 134 shown. The outermost portion of the support element 132 may include a reduced diameter portion 136 which is adapted to receive an outermost helical portion of the lever spring 134 to retain the lever spring 134 on the support element 132.

Figure 11:
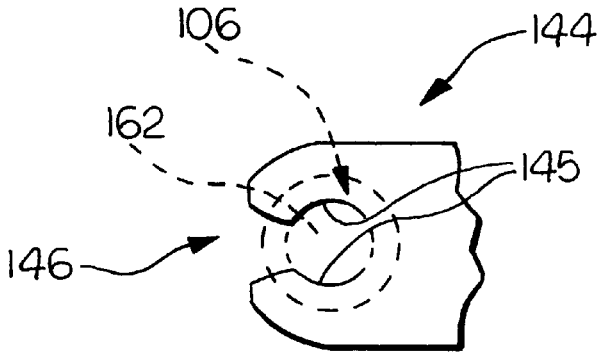
FIG. 11 is an enlarged top plan view of a fork of a lever of the lock shown in FIGS. 7 and 9.

A second or rear cantilevered leg 137 extends rearward from a distal end of the main body portion 130. The rear end of the rear cantilevered leg 137 supports a lock pin retainer 142. The lock pin retainer 142 may include a fork 144 for receiving a portion of the lock pin 106. As shown in FIG. 11, the fork 144 may be provided with a captive opening 146 for receiving a portion of the lock pin 106. The captive opening 146 is structured and dimensioned to trap a portion of the lock pin 106 in the fork 144. Opposing detents 145 may be provided in the fork 144 for engaging a reduced diameter portion 162 of the lock pin 106, as will be described in the description that follows.

Figure 12:
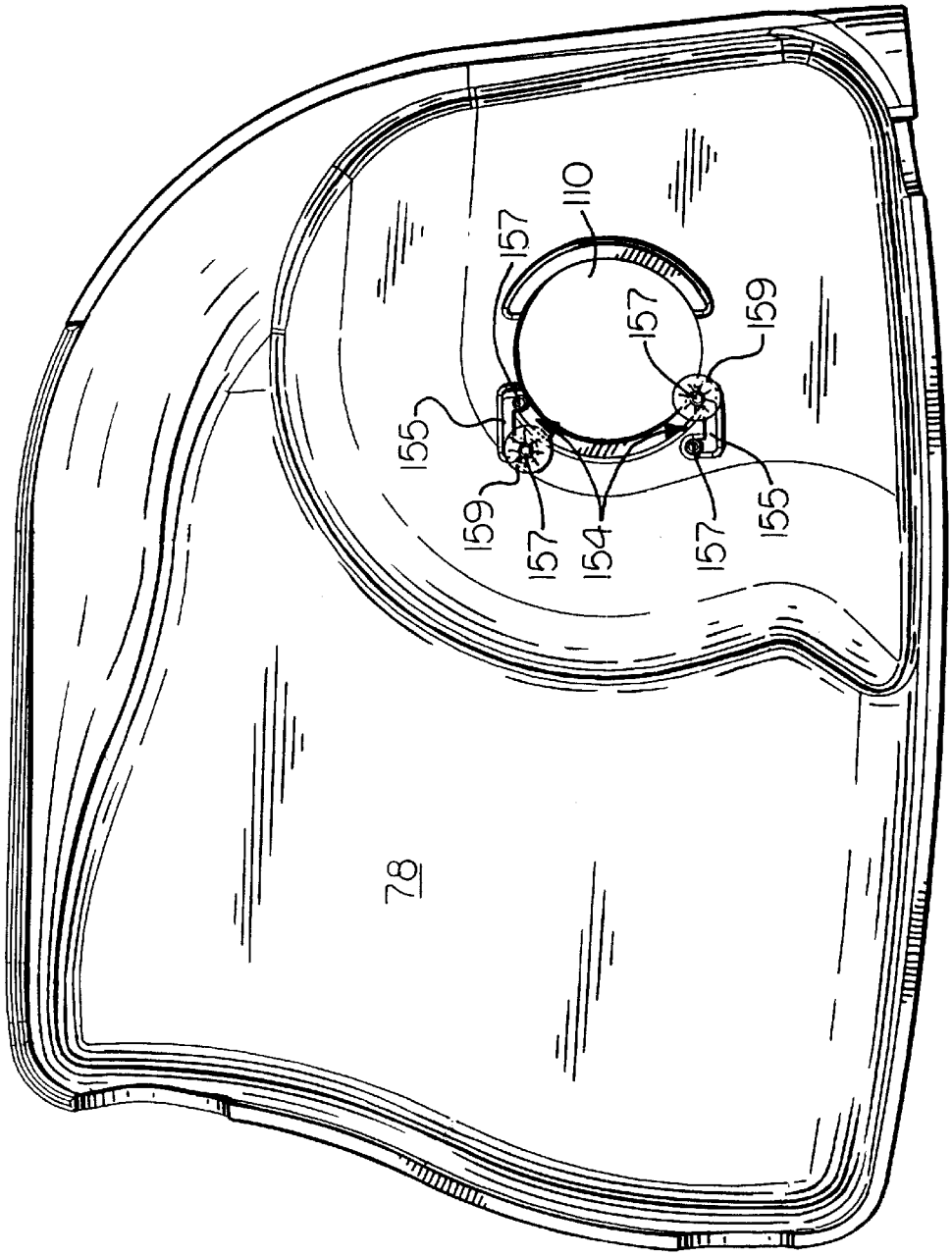
FIG. 12 is a side elevational view of the inside of a side rail housing showing channels for supporting the lock lever.
Figure 13:
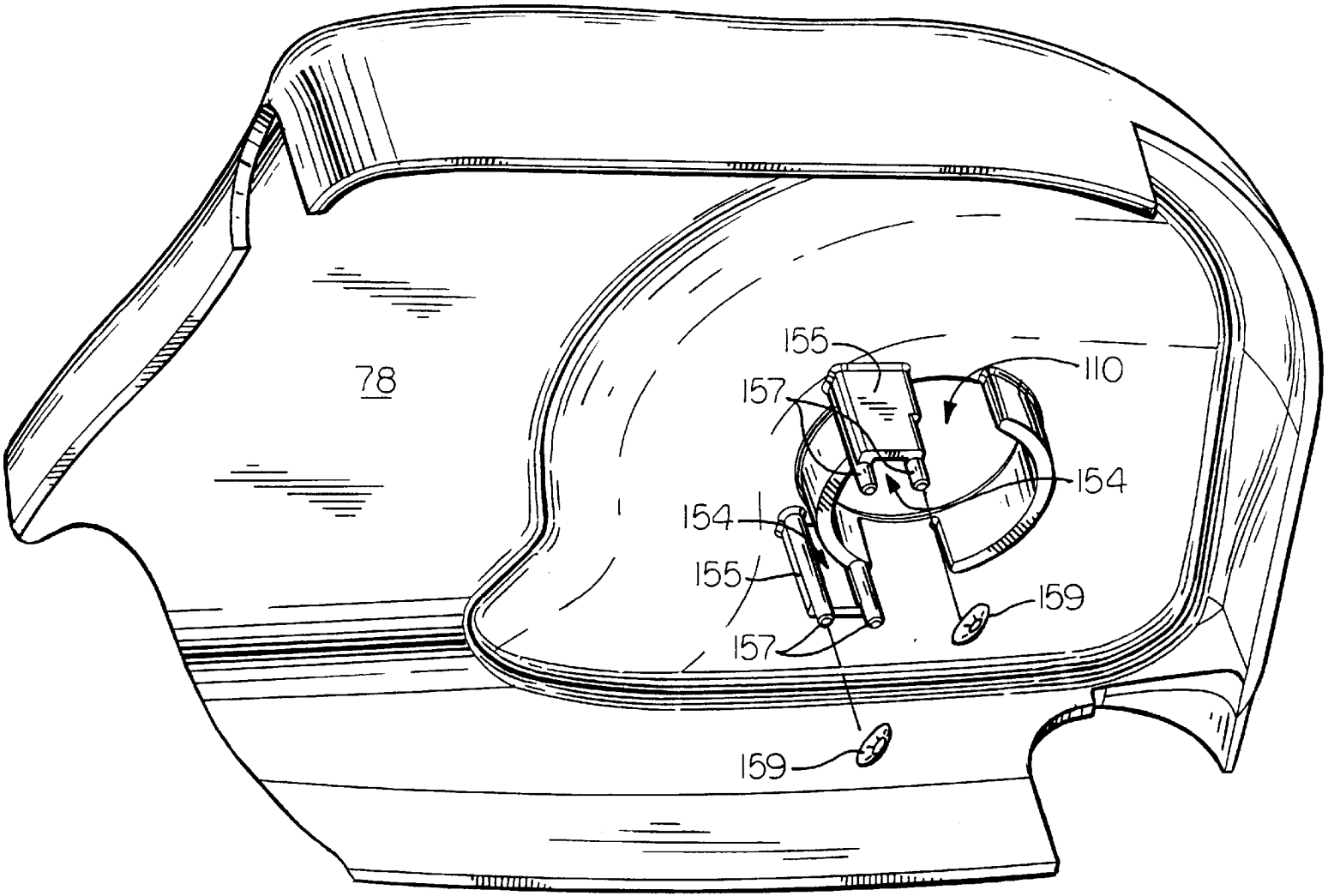
FIG. 13 is a perspective view of the inside of the housing shown in FIG. 12.

A sliding cam or movable pivot surface 148 may be defined by the bottom of the main body portion 130. The movable pivot surface 148 may be in the form of a rocker, such as the rocker shown in the drawings. The movable pivot surface 148 is adapted to engage a substantially vertically disposed plate 150 that is an integral part of the lower bracket 34. As shown in FIG. 8, guide pins 152 may extend from opposing sides of an outer portion of the main body portion 130. The guide pins 152 are linearly or laterally displaceable in slots or channels 154 (shown in FIGS. 9, 12, and 13) supported by the outer inside surface of the housing 78. The channels 154 may be formed between opposing C-shaped elements 155 that protrude inwardly from the outer inside surface of the housing 78. The C-shaped elements 155 are located adjacent or proximate to the button hole 110 in the housing 78. At least one stud 157 may be provided at diagonal legs of the opposing C-shaped elements 155 for engagement with a push-on fastener, such as the push-on fastener 159 shown. The lever 104 may be pre-assembled with the housing 78 by inserting the guide pins 152 into the channels 154 and subsequently engaging the push-on fasteners 159 with the studs 157 to confine the guide pins 152 in the channels 154. As the lever 104 pivots on the movable pivot surface 148, the guide pins 152 move laterally inward and outward in the channels 154 to maintain the lever 104 in a substantially fixed longitudinal and vertical position relative to the housing 78 throughout the pivotal displacement of the lever 104.

As shown in FIG. 9, the guide pins 152 are offset relative to the center S of the movable pivot surface 148 by a predetermined distance. The offset is provided to vary the distribution of leverage between the front and rear cantilevered legs 137, 127 throughout the movement of the lever 104, or throughout the movement of the movable pivot surface 148 relative to the lower bracket plate 150.

The movable pivot surface 148 may be comprised of a continuous arcuate surface which may a plurality of pivot points each defined by a point of contact P1, . . . Pn defined between the movable pivot surface 148 and the lower bracket plate 150. For example, a first point of contact P1 may be provided at the front end of the main body portion 130. A series of intermediate points of contact may be provided along an intermediate portion of the main body portion 130. Lastly, a final point of contact Pn may be provided at the rear end of the main body portion 130.

When the lock pin 106 is in a locked position, the first contact point P1 contacts the lower bracket plate 150, as illustrated in FIG. 9. Upon initially pressing the button 102, the leverage applied by the rear cantilevered leg 137 is greatest to initially displace the lock pin 106. At this point, the demand for leverage may be greatest because the lock pin 106 is initially at a point of rest. By the same token, a demand for leverage to overcome the force of the button 102 is minimized because the compression of the button spring 122 is minimized. As the lock pin 106 is initially displaced, force required to displace the lock pin 106 is greatest. Continued displacement of the lock pin 106 requires less leverage. At the same time, the compression of the lever spring 134 increases. Throughout movement of the lever 104, the successive intermediate contact points contact the lower bracket plate 150. At some point throughout the contact of the intermediate contact points, the leverage is distributed substantially equally among both cantilevered legs 127, 137. Continued compression of the button spring 122 increases the amount of leverage distributed to the front cantilevered leg 127 until the final point of contact Pn is reached, as illustrated in FIG. 14, where the amount of leverage distributed to the front cantilevered leg 127 is greatest.

The front cantilevered leg 127, the main body portion 130, and the rear cantilevered leg 137 should be structured and dimensioned to provide sufficient clearance for displacement of the lever 104 relative to the housing 78. That is to say, there should be sufficient clearance between the support element 132, the main body portion 130, and the housing 78 to permit displacement of the lever 104 without interfering with the lever spring 134 (shown in FIG. 9). There should also be sufficient clearance between the main body portion 130, the rear cantilevered leg 137, and the lock pin 106 to permit displacement of the lever 104 without interfering with the lock pin 106.

It should be appreciated that the lever 104 described above is provided for illustrative purposes and that other levers may be employed to displace the lock pin 106. For example, a lever supported by a fixed pivot or fulcrum may be employed in the place of the lever 104 shown.

Figure 14:
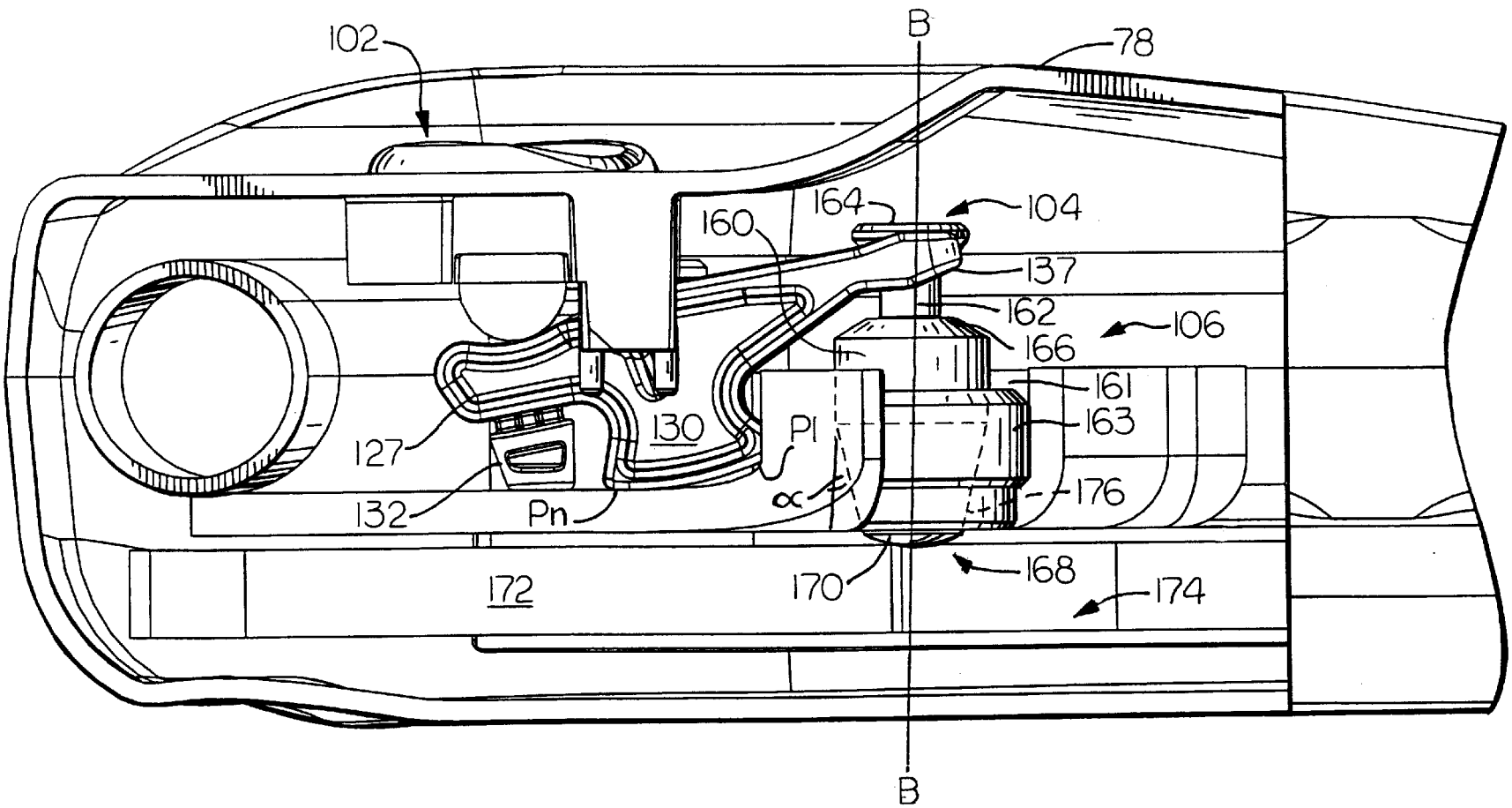
FIG. 14 is a top plan view of the lock shown in FIG. 8.
Figure 15:
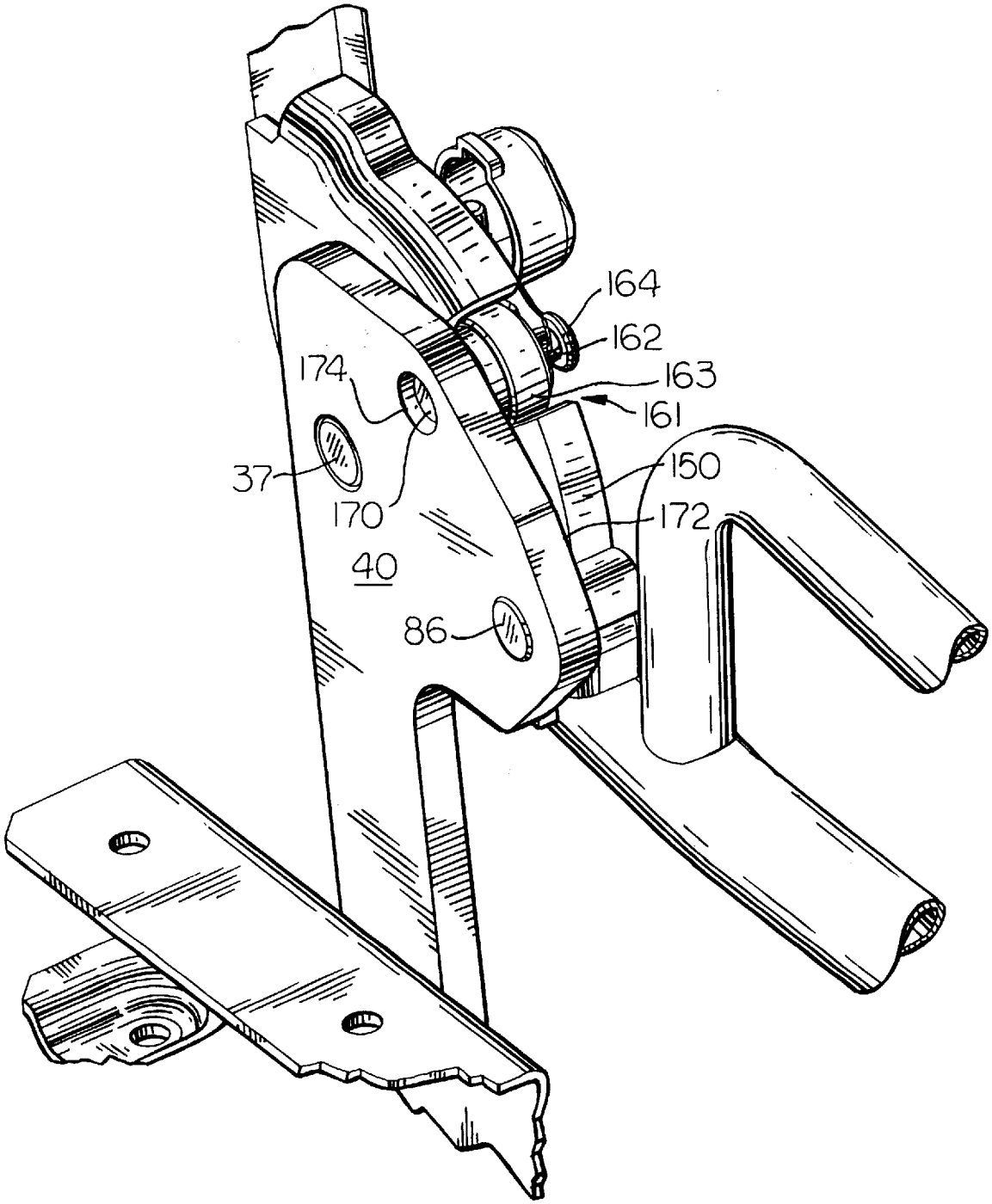
FIG. 15 is an inner rear perspective view of the lock shown in FIG. 7.
Figure 16:
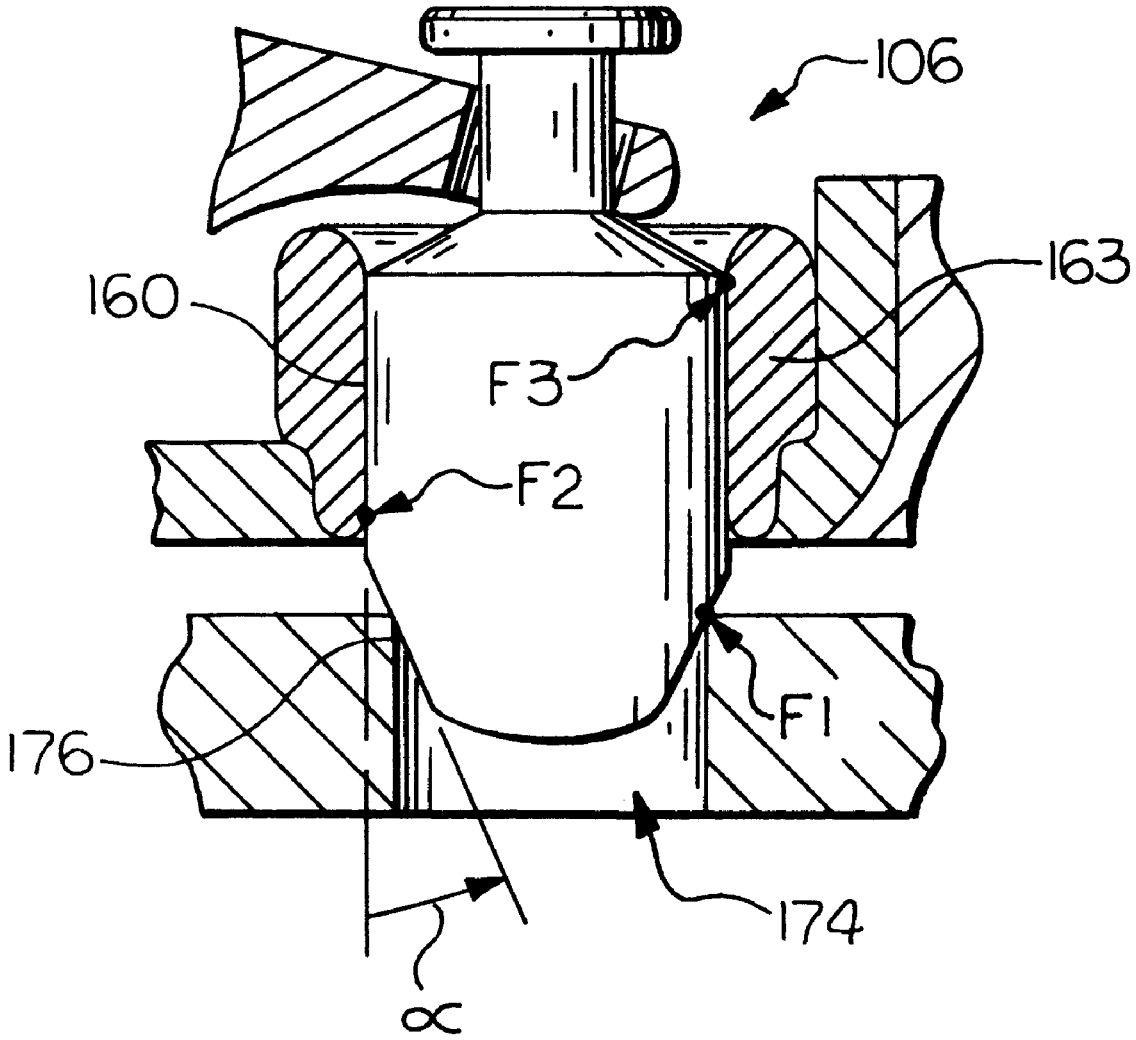
FIG. 16 is a diagrammatic representation in elevation of the lock shown in FIG. 7.

As shown in FIGS. 14–16, the lock pin 106 may include a main body portion 160. The main body portion 160 is displaceable along the line B—B through a hole or relief 161 in the front perimeter of the lower bracket plate 150. The main body portion 160 may be supported by a bushing 163. The bushing 163, in turn, may be supported in the relief 161 in the lower bracket plate 150 (shown in FIG. 16). The bushing 163 should extent laterally outward sufficiently to provide axial support for the main body portion 160 of the lock pin 106.

A reduced diameter portion 162 may extend outwardly from the main body portion 160 and terminate in a head 164 (shown in FIGS. 8, 9, and 14). As stated above, the reduced diameter portion 162 is adapted to be inserted in the fork 144 and retained between the opposing detents 145. The head 164 prevents the fork 144 from pulling away from the lock pin 106. In other words, the fork 144 is retained between the main body portion 160 and the head 164. The lever 104 may pull laterally outward against the head 164 to move the lock pin 106 to an unlocked position. Alternatively, the lever 104 may push laterally inward against the main body portion 160 to move the lock pin 106 to a locked position.

As shown in FIG. 14, the main body portion 160 may be provided with a tapered or chamfered annular surface 166 that is adapted to tightly engage the inner surface of the fork 144. It is preferable that the chamfered surface 166 and the fork 144 cooperate to provide a tight fit between the fork 144 and the lock pin 106.

The inner end, generally indicated at 168, of the lock pin 106 is provided with a slightly spherical or rounded inner surface 170. The rounded inner surface 170 is adapted to traverse or glide smoothly along the outer surface of the locking plate 172 as the side rail 10 is raised and lowered. The locking plate 172 is defined by the irregularly shaped portion formed by the upper end 42 of the driver lever arm 40.

As shown in FIGS. 14 and 15, the locking plate 172 is provided with a lock pin hole 174 for receiving the inner end 168 of the lock pin 106 to lock the side rail 10 in a raised position. The lock pin hole 174 is preferably cylindrical in shape. It should be noted that the rounded surface 170 may provide a smooth transition for the lock pin 106 entering into the lock pin hole 174.

The lock pin 106 is provided with a chamfered or tapered annular surface 176 for engaging the lock pin hole 174. As illustrated in FIG. 16, the tapered surface 176 is structured and dimensioned to fit tightly between three frictional contact points F1, F2, F3. A first frictional contact point F1 is located between the tapered annular surface 176 and the outer opening or edge of the lock pin hole 174. The remaining two frictional contact points F2, F3 are located at two different points of contact between the lock pin 106 and the bushing 163. The tight fit provided between the three frictional contact points F1, F2, F3 holds the lock pin 106 firmly engaged with the lock pin hole 174 while allowing the lock pin 106 to be released from the lock pin hole 174 by application of sufficient force. The force required to release the lock pin 106 from the lock pin hole 174 should be greater than that applied merely by pushing against the side rail 10. In this way, the side rail 10 may be tightly locked in place and free from vibrating. The engagement of the tapered surface 176 with the lock pin hole 174 holds the side rail 10 tightly in a locked position, reducing the risk of the side rail 10 inadvertently becoming unlocked. Moreover, the risk of noise associated with undesirable vibration is reduced.

The lock pin 106 and lock pin hole 174 may be configured as follows. The inside diameter (ID) of the bushing 163 may be about 0.671 inch. The outside diameter (OD) of the main body portion 130 of the lock pin 106 may be about 0.667 inch. The ID of the lock pin hole 174 may be about 0.550 inch. The angle $\alpha$ of the tapered annular surface 176 for a configuration such as this may be about 25 degrees. The physical characteristics of the side rail 10 and the lock 100 may vary. The angle $\alpha$ of the tapered annular surface 176 is dependent upon the physical characteristics of the side rail 10 and the lock 100, as well as other factors, such as material composition. The angle $\alpha$ of the tapered annular surface 176 is also dependent upon the desired distance in which the lock pin 106 may travel through the lock pin hole 174. For example, by maximizing the angle $\alpha$ of the tapered annular surface 176, the distance the lock pin 106 travels through the lock pin hole 174 may be minimized. The angle $\alpha$ is preferably in a range between 10 degrees and 25 degrees, and most preferably in a range between 10 degrees and 15 degrees.

It is preferable that the travel of the lock pin 106 in the lock pin hole 174 terminate prior to reaching the inner surface of the upper end 42 of the driver lever arm 40. This is to prevent the lock pin 106 from protruding beyond the inner surface of the driver lever arm 40 and potentially interfering with other parts, such as the housing 78.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A side rail for use with a bed, said side rail comprising:

a main body;

a first lever arm having an upper end movably supported relative to said main body by an upper pivot pin and a lower end movably attached to the bed by a lower pivot pin; and a second lever arm having an upper end movably supported relative to said main body by an upper pivot pin and a lower end movably attached to the bed by a lower pivot pin, said pivot pins being arranged so that said pivot pins do not come into linear alignment with one another during movement of said lever arms.

2. The side rail according to claim 1, wherein said upper and lower pivot pins of one of said first lever arm are aligned along a first axis and said upper and lower pivot pins of said second lever arm are aligned along a second axis, said upper pivot pins being spaced apart a distance and said lower pivot pins being spaced apart a distance less than the distance that said upper pivot pins are spaced apart.

3. The side rail according to claim 1, wherein said lower pivot pins are at different elevations relative to one another.

4. The side rail according to claim 1, wherein movement of said lever arms is limited by a stop device.

5. The side rail according to claim 1, wherein said lower pivot pins are fixed pivot pins and said upper pivot pins are orbital pivot pins, said orbiting pivot pins having a leading-trailing relation to one another.

6. A side rail for use with a bed, said side rail comprising:

a main body;

a first lever arm having an upper end movably supported relative to said main body and a lower end movably attached to the bed; and a second lever arm spaced apart from said first lever arm, said second lever arm having an upper end movably supported relative to said main body and a lower end movably attached to the bed, said upper ends being spaced apart a distance and said lower ends being spaced apart a distance unequal to the distance between said upper ends.

7. The side rail according to claim 6, wherein said first lever arm is at a lower elevation than said second lever arm.

8. The side rail according to claim 7, wherein the distance between said upper ends of said lever arms is greater than the distance between said lower ends of said lever arms.

9. The side rail according to claim 8, wherein said lever arms are substantially the same length.

10. The side rail according to claim 7, wherein said lever arms are substantially the same length.

11. The side rail according to claim 6, wherein the distance between said upper ends of said lever arms is greater than the distance between said lower ends of said lever arms.

12. The side rail according to claim 11, wherein said lever arms are substantially the same length.

13. The side rail according to claim 6, wherein said lever arms are substantially the same length.

14. The side rail according to claim 6, wherein one of said lever arms leads the other one of said lever arms as said lever arms are moved.

15. The side rail according to claim 6, wherein one of said lever arms leads the other one of said lever arms throughout movement of said lever arms so that said lever arms are prevented from coming into linear alignment with one another throughout movement of said lever arms.

16. A side rail for use with a bed having a sleep surface, said side rail comprising:

a main body having opposite ends;

a driver lever arm having an upper end movably supported relative to one said end of said main body and a lower end movably attached to the sleep surface; and a follower lever arm spaced apart from said driver lever arm, said follower lever arm having an upper end movably supported relative to the other said end of said main body and a lower end movably attached to the sleep surface, said lever arms being out of phase relative to one another so that said driver lever arm leads said follower lever arm as said lever arms are lowered and trails said follower lever arm as said lever arms are raised.

17. A side rail for use with a bed having a sleep surface, said side rail comprising:

a main body having opposite ends;

a driver lever arm having an upper end movably supported relative to one said end of said main body and a lower end movably attached to the sleep surface; and a follower lever arm spaced apart from said driver lever arm, said follower lever arm having an upper end movably supported relative to the other said end of said main body and a lower end movably attached to the sleep surface, said lever arms being out of phase relative to one another so that said driver lever arm leads said follower lever arm as said lever arms are lowered and trails said follower lever arm as said lever arms are raised, wherein said driver lever arm is at a lower elevation than said follower lever arm.

18. The side rail according to claim 17, wherein said upper ends of said lever arms are spaced apart a distance and said lower ends of said lever arms are spaced apart a distance less than the distance between said upper ends.

19. The side rail according to claim 18, wherein said levers arms are substantially the same length.

* * * * *